US005164122A

United States Patent [19]

Lange et al.

[11] Patent Number: 5,164,122

[45] Date of Patent: Nov. 17, 1992

[54] THERMAL OXIDATIVELY STABLE SYNTHETIC FLUID COMPOSITION

[75] Inventors: Richard M. Lange, Euclid; Mary F. Salomon, Cleveland Heights, both of Ohio

[73] Assignee: The Lubrizol Corporation, Wickliffe, Ohio

[21] Appl. No.: 622,300

[22] Filed: Dec. 5, 1990

Related U.S. Application Data

[63] Continuation of Ser. No. 182,544, Apr. 18, 1988, abandoned.

[51] Int. Cl.[5] ..... C10M 129/68; C10M 129/72

[52] U.S. Cl. ..... 252/565; 252/56 R; 560/76; 560/80; 560/85

[58] Field of Search ..... 560/76, 80, 85; 252/56 R, 565

[56] References Cited

U.S. PATENT DOCUMENTS

| | | | |
|---|---|---|---|
| 2,512,255 | 6/1950 | Montgomery et al. | 252/79 |
| 3,028,352 | 4/1962 | Hecker et al. | 260/31.6 |
| 3,461,136 | 8/1969 | Pruckmayr et al. | 252/76 |
| 3,624,133 | 11/1971 | Reitsema et al. | 260/475 FR |
| 3,627,818 | 12/1971 | Blake | 252/56 R |
| 3,637,501 | 1/1972 | Malec et al. | 252/57 |
| 3,928,401 | 12/1975 | Sturwold et al. | 252/56 S |
| 3,947,367 | 3/1976 | Leibfried | 252/56 S |
| 3,974,081 | 8/1976 | Rutbowski et al. | 252/79 |
| 3,981,838 | 9/1976 | Wilson | 560/76 |
| 4,036,773 | 7/1977 | Okorodudu | 252/56 R |
| 4,062,824 | 12/1977 | Dieterman et al. | 560/76 |
| 4,098,970 | 7/1978 | Hahn | 560/85 |
| 4,111,821 | 9/1978 | Lazarus et al. | 252/99.9 |
| 4,157,990 | 6/1979 | Linder et al. | 252/56 S |
| 4,440,945 | 4/1984 | Conciatori et al. | 560/80 |
| 4,464,277 | 8/1984 | Cousineau et al. | 252/56 S |
| 4,472,466 | 9/1984 | Kelly et al. | 560/76 |
| 4,491,528 | 1/1985 | Rossi et al. | 252/56 S |
| 4,543,420 | 9/1985 | Godwin et al. | 560/76 |
| 4,683,327 | 7/1987 | Stackman | 560/80 |
| 4,695,649 | 9/1987 | Magani et al. | 560/85 |
| 4,790,957 | 12/1988 | Mach et al. | 560/76 |
| 4,841,094 | 6/1989 | Towle | 560/76 |

FOREIGN PATENT DOCUMENTS

| | | | |
|---|---|---|---|
| 0157583 | 10/1985 | European Pat. Off. . | |
| 1200141 | 12/1959 | France . | |
| 1242842 | 7/1962 | France . | |
| 60-92836 | 7/1981 | Japan | 560/76 |
| 161948 | 8/1985 | Japan | 560/80 |
| 304073 | 12/1988 | Japan | 560/76 |
| 851205 | 10/1960 | United Kingdom . | |

*Primary Examiner*—Ellen McAvoy

*Attorney, Agent, or Firm*—Joseph P. Fischer; Frederick D. Hunter; James L. Cordek

[57] ABSTRACT

A thermal oxidatively stable synthetic fluid composition is disclosed. The composition is essentially comprised of an aromatic carboxylic acid ester of the general formula

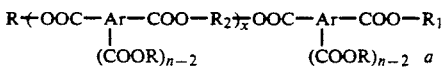

(I)

wherein Ar is an aromatic moiety, R is a neo hydrocarbyl group containing from about 5 to about 18 carbon atoms, with the proviso that R is not a cycloalkyl substituted neo hydrocarbyl group, $R_1$ is a mono, di, tri or tetra functional hydrocarbyl group containing from 1 to about 18 carbon atoms, n is an integer from about 2 to about 4 and represents the total number of carboxylic acid ester groups on the aromatic moiety, a is an integer from about 1 to about 4, when a is 1 $R_1$ is monovalent, when a is 2 $R_1$ is divalent, when a is 3 $R_1$ is trivalent and when a is 4 $R_1$ is tetravalent, $R_2$ is a hydrocarbyl group derived from a diol containing from about 2 to about 18 carbon atoms and x is an integer from 0 to about 4.

53 Claims, No Drawings

THERMAL OXIDATIVELY STABLE SYNTHETIC FLUID COMPOSITION

This is a continuation of copening application Ser. No. 07/182,544 filed on Apr. 18, 1988, now abandoned.

FIELD OF THE INVENTION

This invention relates to the preparation of aromatic carboxylic acid esters and to the use of such esters as novel thermally and oxidatively stable synthetic fluids. More particularly, the invention relates to their use in the field of thermal oxidatively stable synthetic fluid lubrication.

BACKGROUND OF THE INVENTION

Many types of synthetic fluids useful as lubricating oils are available, including hydrogenated poly-alpha-olefins, aliphatic esters of aliphatic dibasic acids, trimethylolpropane aliphatic esters, pentaerythritol aliphatic esters, silicones, silicate esters, and phosphate esters. For a detailed discussion, see R. C. Gunderson and A. W. Hart, editors, "Synthetic Lubricants", (1962). These fluids were developed as improvements over refined mineral oils, adding such benefits as improved thermal stability, improved oxidative stability, superior volatility characteristics, better viscosity/temperature characteristics, and improved frictional properties. The use of synthetic lubricants has expanded considerably in recent years. New applications for synthetic fluids bring new demands for performance. Changes in lubricated equipment design and operating temperatures impose further requirements for upgraded fluid performance.

DESCRIPTION OF RELATED ART

U.S. Pat. No. 3,947,369 (Liebfried, Mar. 30, 1976) discloses a synthetic oil useful as a base stock for jet engine lubricating oils. In summary, the patent describes a lubricating oil base stock. which meets both the 210° F. initial viscosity requirement, and the 72 hour no-freeze requirement. The base stock is composed of a blend of (1) a pentaerythritol ester product consisting essentially of pentaerythritol material completely esterified by straight chain $C_4$–$C_{10}$ alkanoic acid material, and (2) trimellitate ester product consisting essentially of trimellitic acid completely esterified by $C_4$–$C_{13}$ alkanol material. The weight ratio of trimellitate ester product to the pentaerythritol ester product in the blend is generally in the range from about 1:10 to about 1:1.

U.S. Pat. No. 3,974,081 (Rutkowski et al, Aug. 10, 1976) relates to an improved lubricating fluid and particularly concerns an additive for such a fluid that will improve its seal swelling properties without at the same time imparting any detrimental effects thereto. The invention is also directed to additive concentrate packages that are intended for formulation into mineral oil base stocks to provide transmission fluids of improved seal swelling characteristics thereby enhancing fluid retention. These transmission fluids have utility as a lubricant for rotary engines. The additive is an oil soluble, saturated, aliphatic or aromatic hydrocarbon ester having from 10 to 60 carbon atoms and from 2 to 4 ester linkages. For some applications it is desired that an aliphatic alcohol having from 8 to 13 carbon atoms be present in up to equal amount with said ester as a co-swellant. Preferred among the above class of esters is dihexyl phthalate and among the above class of alcohols is tridecyl alcohol.

U.S. Pat. No. 4,157,990 (Linder et al, Jun. 12, 1979) refers to the development of lubricant and detackifying compositions with a content of A. mixed esters with hydroxyl and acid numbers of 0 to 6 of
   (a) aliphatic, cycloaliphatic and/or aromatic dicarboxylic acids,
   (b) aliphatic polyols,
   (c) aliphatic monocarboxylic acids with 12 to 30 carbon atoms in the molecule, and B. esters from long-chain aliphatic monofunctional alcohols with 32 to 72 carbon atoms in the molecule and long-chain monocarboxylic acids with 18 to 72 carbon atoms in the molecule, where the weight ratio by weight of mixed esters (A) to esters (B) is 9:1 to 1:3.

SUMMARY OF THE INVENTION

The present invention is a thermally and oxidatively stable synthetic fluid composition comprising an aromatic carboxylic acid ester of the general formula $$\left[R\left(OOC-\underset{\underset{(COOR)_{n-2}}{|}}{Ar}-COO-R_2\right)_x OOC-\underset{\underset{(COOR)_{n-2}}{|}}{Ar}-COO\right]_a R_1 \quad (I)$$

wherein Ar is an aromatic moiety, R is a neo hydrocarbyl group containing from about 5 to about 18 carbon atoms, with the proviso that R is not a cycloalkyl substituted neo hydrocarbyl group, $R_1$ is a mono, di, tri or tetra functional hydrocarbyl group containing from 1 to about 18 carbon atoms, n is an integer from about 2 to about 4 and represents the total number of carboxylic acid ester groups on the aromatic moiety, a is an integer from 1 to about 4, when a is 1 $R_1$ is monovalent, when a is 2 $R_1$ is divalent, when a is 3 $R_1$ is trivalent and when a is 4 $R_1$ is tetravalent, $R_2$ is a hydrocarbyl group derived from a diol containing from about 2 to about 18 carbon atoms and x is an integer from 0 to about 4.

A primary object of this invention is to provide a novel thermally and oxidatively stable synthetic fluid composition of an aromatic carboxylic acid ester.

A feature of the invention is that the aromatic carboxylic acid esters which function as the novel thermally and oxidatively stable synthetic fluid composition can be easily and economically manufactured.

An advantage of the present composition is that the aromatic carboxylic acid ester compositions provide lubricating properties which are desirable for synthetic fluid compositions.

DETAILED DESCRIPTION OF THE PREFERRED EMBODIMENTS OF THE INVENTION

The thermal stability of a chemical compound is its resistance to change brought about solely by thermal energy. The rate of thermal decomposition as a function of temperature precisely defines this property.

In this jet and space age more and more emphasis is on thermal stability. Higher operating temperatures, for increased engine efficiency, require more thermally stable lubricants. For lubricants and hydraulic fluids it is apparent that other properties such as viscosity, pour point, oxidative stability and vapor pressure are quite important, but such properties are more amenable to improvement by additives and minor structural modifications than is thermal stability.

Applicants have discovered that certain aromatic carboxylic acid esters possess a high degree of thermal and oxidative stability. The aromatic carboxylic acid esters which are used in the composition in accordance with the present invention are compounds characterized by the structural formula:

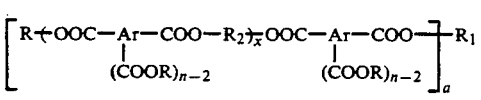

(I)

wherein Ar is an aromatic moiety, R is a neo hydrocarbyl group containing from about 5 to about 18 carbon atoms, with the proviso that R is not a cycloalkyl substituted neo hydrocarbyl group, $R_1$ is a mono, di, tri or tetra functional hydrocarbyl group containing from 1 to about 18 carbon atoms, n is an integer from about 2 to about 4 and represents the total number of carboxylic acid ester groups on the aromatic moiety, a is an integer from 1 to about 4, when a is 1 $R_1$ is monovalent, when a is 2 $R_1$ is divalent, when a is 3 $R_1$ is trivalent and when a is 4 $R_1$ is tetravalent, $R_2$ is a hydrocarbyl group derived from a diol containing from about 2 to about 18 carbon atoms and x is an integer from 0 to about 4.

The aromatic carboxylic acid ester is prepared by reacting an alcohol with an aromatic acid or anhydride, or their esters (as in transesterification). However, in order to force the esterification reaction to completion, an excess of the alcohol is employed. Normally, the alcohol is present in a 100% excess on an equivalent basis. Preferably, the alcohol is present in a 50% excess. The unreacted alcohol may be removed by distillation after the esterification reaction is complete and reused in future esterification reactions.

Normally, the alcohol and aromatic acid or anhydride are added to a reaction vessel at room temperature. Stirring is begun and an acid catalyst is added to promote the reaction. Catalysts that can be used in the practice of this invention are methanesulfonic acid, para-toluene-sulfonic acid and tetraalkyl titanates. The catalyst of choice is para-toluene sulfonic acid. Upon completion of the esterification, the catalyst is neutralized with an appropriate base, such as aqueous sodium hydroxide or calcium hydroxide.

As used in this specification and appended claims, the term "hydrocarbyl" denotes a group having a carbon atom directly attached to the remainder of the molecule and having predominantly hydrocarbon character within the context of this invention. Such groups include the following:

(1) Hydrocarbon groups; that is, aliphatic (e.g., alkyl, aromatic, aliphatic- substituted aromatic, aromatic-substituted aliphatic and alicyclic groups, and the like. Typical hydrocarbon groups are known to those skilled in the art. These hydrocarbon groups may be monovalent, as well as di-, tri- or tetravalent. That is, there may be one or more points of attachment of the hydrocarbon groups to carboxy groups within the same complex ester molecule. Examples include octyl, decyl, octadecyl, propylene, butylene, butanetriyl, pentanetriyl, the tetra valent moiety derived from pentaerythritol, etc.

(2) Hetero groups; that is, groups which, while predominantly hydrocarbon in character within the context of this invention, contain atoms other than carbon in a chain or ring otherwise composed of carbon atoms. Suitable heteroatoms will be apparent to those skilled in the art and include, for example, nitrogen, oxygen and sulfur.

In general, no more than about three substituents or heteroatoms, and preferably no more than one, will be present for every 10 carbon atoms in the hydrocarbyl group.

The Aromatic Moiety, Ar

The aromatic moiety, Ar, can be a single aromatic nucleus such as a benzene nucleus or a polynuclear aromatic moiety. Such polynuclear moieties can be of the fused type; that is, wherein at least two aromatic nuclei are fused at two points to another nucleus such as found in naphthalene, anthracene, etc. Such aromatic moieties also can be of the linked type wherein at least two nuclei are linked through bridging linkages to each other. Such bridging linkages can be chosen from the group consisting of carbon-to-carbon single bonds, ether linkages, keto linkages, alkylene linkages, and mixtures of such divalent bridging linkages.

The aromatic moiety Ar in all cases is derived from the group consisting of aromatic carboxylic acids, aromatic anhydrides and aromatic esters. Specific examples of single ring Ar moieties are the following wherein $R_1$ and a are as defined in the Summary of the Invention:

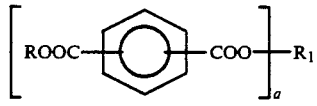

where n = 2, x = 0

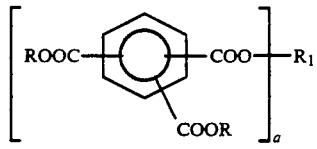

where n = 3, x = 0

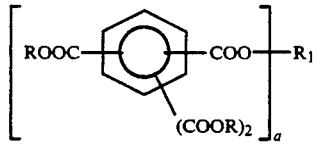

where n = 4, x = 0

Specific examples of fused ring aromatic moieties Ar are:

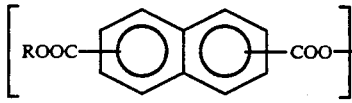

where n = 2, x = 0

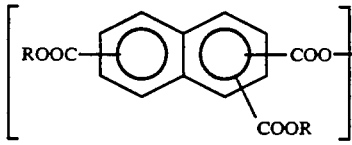

where n = 3, x = 0

-continued

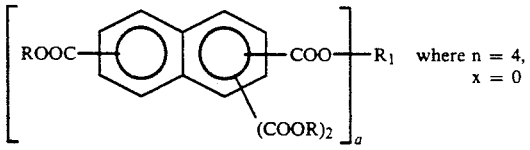

Examples of Ar where it is a linked polynuclear aromatic moiety include:

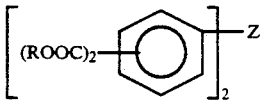

(II)

and

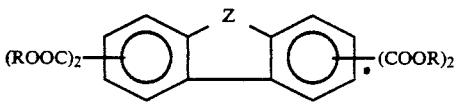

(III)

wherein Z is selected from the group consisting of

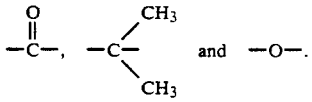

Usually, all of these carboxylic acid bearing Ar moieties are otherwise unsubstituted except for stable hydrocarbyl groups, hydrocarbylene groups and any bridging groups.

Suitable aromatic carboxylic acids are represented by the formula Ar—(—COOH)$_n$ where Ar is an aromatic moiety and n is an integer between 2 and 4. Aromatic carboxylic acids falling within the parameters of the above structure include phthalic acid, isophthalic acid, terephthalic acid, hemimellitic acid, trimellitic acid, pyromellitic acid, trimesic acid, naphthalene 1,8-dicarboxylic acid, naphthalene 2,3-dicarboxylic acid, naphthalene-1,4-dicarboxylic acid, naphthalene 2,6-dicarboxylic acid and naphthalene 2,3,6-tricarboxylic acid.

Anhydrides corresponding to any of the above aromatic carboxylic acids are also within the scope of the present invention. Anhydrides are represented by the formula

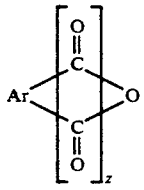

wherein Ar is as defined above and z is an integer from 1 to 3, preferably 1 to 2. Suitable anhydrides are phthalic anhydride, 1,8-naphthalic anhydride, 2,3-naphthalic anhydride, 2,3,7,8-naphthalic dianhydride, trimellitic anhydride, pyromellitic anhydride, mellitic anhydride and benzophenonetetracarboxylic acid dianhydride.

Aromatic carboxylic acid esters which may be used to prepare the products of this invention by transesterification are represented by the formula $$Ar\text{-}(COOR_7)_n$$

wherein Ar and n are defined above and $R_7$ is a hydrocarbyl group containing from 1 to 6 carbon atoms. Aromatic esters that can be employed in this invention are dimethyl phthalate, trimethyl trimellitate, diethyl phthalate and dimethyl naphthalene-2,6-dicarboxylate.

For such reasons as cost, availability, performance, etc., the Ar moiety is normally a benzene nucleus, keto-bridged benzene nuclei or a naphthalene nucleus.

The Neo Hydrocarbyl Group R

The neo hydrocarbyl group R is an aliphatic group. The neo hydrocarbyl group R contains from 5 to 18 carbon atoms with the proviso that R is a neo hydrocarbyl group other than a cycloalkyl substituted neo hydrocarbyl group. The neo hydrocarbyl group R has the structure:

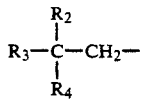

wherein $R_2$, $R_3$ and $R_4$ are independently straight chain hydrocarbyl groups, branched chain hydrocarbyl groups or mixtures thereof. Preferably, the neo hydrocarbyl group contains from 8 to 16 carbon atoms, and most preferably the neo hydrocarbyl group is a neo octyl group. In all cases, the hydrocarbyl group is usually derived from an alcohol.

Specific examples of hydrocarbyl groups of $R_2$, $R_3$ and $R_4$ include methyl, ethyl, propyl, isopropyl, butyl, isobutyl, sec-betyl and t-butyl. Non-limiting examples of neo alcohols that may be employed in the practice of this invention are: 2,2-dimethyl-1-heptanol, 2,2-di-methyl-1-octanol, 2-methyl-2-ethyl-1-pentanol, 2-methyl-2-ethyl-1-hexanol, 2-methyl-2-ethyl-1-heptanol, 2-methyl-2-ethyl-1-octanol, 2,2-diethyl-1-butanol, 2,2-diethyl-1-pentanol, 2,2-diethyl-1-hexanol, 2,2-diethyl-1-heptanol, 2,2-diethyl-1-octanol, 2,2,3-trimethyl-1-pentanol, 2,2,3-trimethyl-1-hexanol, 2,2,3-trimethyl-1-heptanol, 2,2,3-trimethyl-1-heptanol, 2,2,3-trimethyl-1-octanol, 2,3-dimethyl-2-ethyl-1-butanol, 2,2,4-trimethyl-1-pentanol, 2,2,4-trimethyl-1-hexanol, 2,2,4-trimethyl-1-heptanol, 2,2,4-trimethyl-1-octanol, 2,2,3,3,-tetramethyl-1-butanol and 2,2,4-trimethyl-1-pentanol.

The Hydrocarbyl Group $R_1$

The hydrocarbyl group $R_1$ is a mono, di, tri or tetra functional hydrocarbyl group containing from 1 to about 18 carbon atoms, preferably from about 5 to about 16 carbon atoms and most preferably from about 5 to about 12 carbon atoms.

The hydrocarbyl group $R_1$ is derived from an alcohol containing from 1 to 4 hydroxyl groups and may be represented as $R_1$—(—OH)$_a$ wherein a is from 1 to 4.

When a is 1, $R_1$ is derived from a mono alcohol. The mono alcohols may be the neo alcohols as described and also non neo alcohols.

The non-neo alcohols which can be utilized to form the desired product of this invention are well-known alcohols. These alcohols are primary alcohols.

Suitable alcohols include, for example, 2-ethylhexanol, n-octanol, isooctanol, 2,2-dimethyloctanol, nonanol, n-decanol, isodecanol, dodecanol, tridecyl alcohol, tetradecanol, hexadecanol, octadecanol, etc.

Commercial alcohols (mixtures) are contemplated herein, and these commercial alcohols may comprise minor amounts of alcohols which, although not specified herein, do not detract from the purpose of this invention. Higher synthetic monohydric alcohols of the type formed by the Oxo process (e.g., isodecyl), the aldol condensation (e.g., 2-ethylhexyl), or by organoaluminum-catalyzed oligomerization of alpha-olefins (especially ethylene), followed by oxidation, also are useful.

An example of a preferred alcohol and alcohol mixture suitable for forming the compositions of the invention include commercially available "Alfol" alcohols marketed by Vista Chemical Corporation. Alfol 810 is a mixture containing alcohols consisting essentially of straight chain, primary alcohols having from 8 to 10 carbon atoms.

A variety of mixtures of monohydric fatty alcohols derived from naturally occurring triglycerides and ranging in chain length from $C_8$ to $C_{18}$ are available from Procter & Gamble Company. These mixtures contain various amounts of fatty alcohols containing mainly 12, 14, 16 or 18 carbon atoms. For example, CO-1214 is a fatty alcohol mixture containing 0.5 percent of $C_{10}$ alcohol, 66.0 percent of $C_{12}$ alcohol, 26.0 percent of $C_{14}$ alcohol and 6.5 percent of $C_{16}$ alcohol.

Another group of commercially available mixtures include the "Neodol" products available from Shell Chemical Co. For example, Neodol 23 is a mixture of $C_{12}$ and $C_{13}$ alcohols; and Neodol 45 is a mixture of $C_{14}$ and $C_{15}$ alcohols.

An example of a preferred branched chain monohydric alcohol suitable for use in the present invention is commercial tridecyl alcohol, a mixture of isomers in the $C_{13}$ range prepared by the Oxo process and which is available from Exxon Corporation.

When a is 2, $R_1$ is derived from a diol. Suitable examples of $R_1$—(—OH)$_2$ are 2,2-dimethyl-1,3-propanediol; 2,2,4,4-tetramethyl-1,5-pentanediol; 2,2,5,5-tetramethyl-1,6-hexanediol; 2,2,6,6-tetramethyl-1,7-heptanediol; 2,2,7,7-tetramethyl-1,8-octanediol.

When a is 3, $R_1$ is derived from a triol. The triol $R_1$—(—OH)$_3$ is represented by the formula

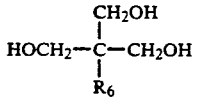

wherein $R_6$ is a hydrocarbyl group containing from 1 to about 14 carbon atoms, preferably 1 to 10 carbon atoms, and most preferably 1 to 6 carbon atoms. Suitable examples of this structure are trimethylolethane, trimethylolpropane, trimethylolbutane, trimethylolpentane, etc.

When a is 4, $R_1$ is derived from a tetraol represented by the structure:

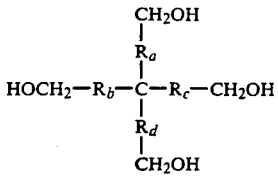

wherein $R_a$, $R_b$, $R_c$ and $R_d$ may be the same or different and are hydrocarbyl groups containing from zero up to about 3 carbon atoms. When the hydrocarbyl groups $R_a$, $R_b$, $R_c$ and $R_d$ contain no carbon atoms, $R_1$ is derived from pentaerythritol.

A preferred embodiment of this invention comprises an aromatic carboxylic acid ester of the general formula

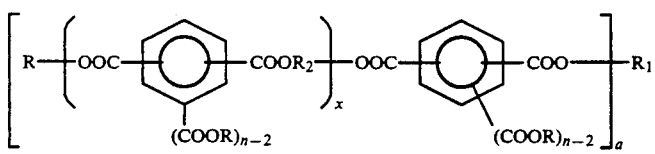

(IV)

wherein R is a neo hydrocarbyl group containing from about 5 to about 10 carbon atoms, $R_1$ is a di, tri or tetra functional hydrocarbyl group containing from about 5 to about 16 carbon atoms, n is an integer from about 2 to about 4 and represents the total number of carboxylic acid ester groups on the aromatic moiety; a is an integer from about 2 to about 4 with the proviso that when a is 2 $R_1$ is divalent, when a is 3 $R_1$ is trivalent and when a is 4 $R_1$ is tetravalent, $R_2$ is a hydrocarbyl group from a diol containing from about 2 to about 12 carbon atoms and x is an integer from 0 to about 4.

An alternative embodiment of this invention comprises an aromatic carboxylic acid ester of the formula

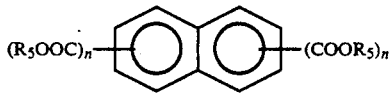

(V)

wherein $R_5$ is a hydrocarbyl group containing from about 2 to about 18 carbon atoms, preferably from about 5 to about 18, and most preferably from about 5 to about 16, with the proviso that $R_5$ is a primary hydrocarbyl group other than a neo hydrocarbyl group and n is an integer from 1 to about 4 with the proviso that there can be no more than four —(—COOR$_5$) groups total in the ester.

Another embodiment of this invention comprises an aromatic carboxylic acid ester of the general formula

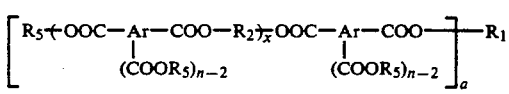

(VI)

wherein Ar is an aromatic moiety, $R_5$ is a linear hydrocarbyl group containing from about 2 to about 18 carbon atoms, $R_1$ is a di, tri or tetra functional hydrocarbyl group containing from 1 to about 18 carbon atoms, n is an integer from about 2 to about 4 and represents the total number of carboxylic acid ester groups on the aromatic moiety, a is an integer from about 2 to about 4, when a is 2 $R_1$ is divalent, when a is 3 $R_1$ is trivalent and when a is 4 $R_1$ is tetravalent, $R_2$ is a hydrocarbyl group derived from a diol containing from about 2 to about 18 carbon atoms and x is an integer from 0 to about 4.

A further embodiment of this invention comprises an aromatic carboxylic acid ester of the general formula

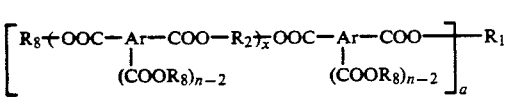

(VII)

wherein Ar is an aromatic moiety, $R_8$ comprises a mixture of R and $R_5$ wherein R is a neo hydrocarbyl group containing from about 5 to about 18 carbon atoms, with the proviso that R is not a cycloalkyl substituted neo hydrocarbyl group, $R_5$ is a linear primary hydrocarbyl group containing from about 2 to about 18 carbon atoms, $R_1$ is a mono, di, tri or tetra functional hydrocarbyl group containing from 1 to about 18 carbon atoms, n is an integer from about 2 to about 4 and represents the total number of carboxylic acid ester groups on the aromatic moiety, a is an integer from about 1 to about 4, when a is 1 $R_1$ is monovalent, when a is 2 $R_1$ is divalent, when a is 3 $R_1$ is trivalent and when a is 4 $R_1$ is tetravalent, $R_2$ is a hydrocarbyl group derived from a diol containing from about 2 to about 18 carbon atoms and x is an integer from 0 to about 4.

A still further embodiment of this invention comprises an aromatic carboxylic acid ester of the general formula

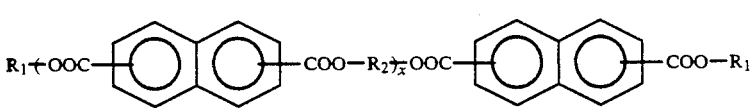

(VIII)

wherein $R_1$ is a mono functional primary hydrocarbyl group containing from 1 to about 18 carbon atoms, $R_2$ is a hydrocarbyl group derived from a diol containing from about 2 to about 18 carbon atoms and x is an integer from 1 to about 4.

The Hydrocarbyl Group $R_2$

The hydrocarbyl group $R_2$ is derived from a di-hydric alcohol containing between 2 and 18 carbon atoms. Preferably $R_2$ contains between 2 and 12 carbon atoms, and most preferably between 2 and 8 carbon atoms. Suitable di-hydric alcohols include ethylene glycol; 1,3-propylene glycol; 1,4-butane diol; neopentyl glycol; 1,5-pentane diol; 1,6-hexane diol and mixtures thereof.

The preparation of specific compounds of the present invention are further illustrated in the examples that follow. While these examples are presented to show one skilled in the art how to operate within the scope of this invention, they are not to serve as a limitation on the scope of the invention where such scope is defined in the claims. It is pointed out that in the following examples, and elsewhere in the present specification and claims, all percentages are intended to express percent by weight and all parts are intended to express parts by weight unless otherwise specified.

EXAMPLE 1

A one-liter flask, equipped with a Dean-Stark trap, condenser, thermowell, stirrer and nitrogen inlet tube, is charged with 166 parts (1 mole) of terephthalic acid, 144 parts of Alfol 8-10 alcohol (1 mole), 144 parts of 2,2,4-trimethyl-1-pentanol (1.1 mole), 10 parts of p-toluenesulfonic acid monohydrate and 200 parts xylene. The contents are heated to reflux under a slow nitrogen purge, and water is removed by azeotropic distillation over an 8-hour period. The temperature is gradually increased to 175° C. over two hours by slow removal of toluene and azeotrope, and held at that temperature for two hours while additional volatiles are removed. The reaction mixture is cooled to 150° C., and a vacuum (10 Torr) is applied to remove volatiles at that temperature. The stripped mixture is then cooled to 90° C., stirred for 30 minutes with 15 parts of calcium hydroxide to neutralize the acid catalyst, then filtered through a thin pad of diatomaceous earth to give the ester product.

EXAMPLE 2

To a 2-liter flask equipped with a Dean-Stark trap, condenser, thermowell, stirrer and subsurface nitrogen sparging tube, is charged 384 parts (2 moles) of trimellitic anhydride, 104 parts (1 mole) of neopentyl glycol and 400 parts of toluene. The mixture was heated to gentle reflux with stirring and a slow nitrogen sparge, and held there for 30 minutes. Then, 526 parts (4.1 moles) of 2,2,4-trimethylpentanol and 8 parts of p-toluenesulfonic acid monohydrate are added, and the mixture held at reflux for 16 hours, while water is removed by azeotropic distillation. The reaction mixture was stripped at 120° C./15 Torr, then treated with 7 parts of calcium hydroxide for 30 minutes. Filtration through a thin pad of diatomaceous earth in a Buchner funnel gave 834 parts of a light yellow, viscous ester product.

EXAMPLE 3

To a flask fitted per Example 1 are added 47.1 parts (0.146 moles) benzophenone tetracarboxylic acid anhydride, 95 parts (0.73 moles) 2,2,4-trimethyl-1-pentanol, 100 parts xylene and 2 parts (0.01 moles) para-toluene sulfonic acid. The contents are heated to reflux and maintained for 11 hours. At 80° C., 1.5 parts (0.02 moles) calcium hydroxide are added to neutralize the catalyst. The contents are stripped to 180° C. and 10 mm mercury to obtain a product with a phenolphthalein neutralization number of 0.7.

EXAMPLE 4

To a flask fitted per Example 1 is added 498 parts (3 moles) of isophthalic acid and 700 parts xylene. The solution is heated to 65° C. under a slow nitrogen purge, and 384 parts (3 moles) of 2-methyl-2-ethyl-1-pentanol are added. At 70° C., 120 parts (1 mole) of trimethylolethane and 10 parts of p-toluenesulfonic acid monohydrate are added, and the temperature is increased to reflux. Water is removed by azeotropic distillation over a 12-hour period, and the reaction mixture is then stripped at 140° C./10 Torr to remove volatiles. The reaction mixture is cooled to 90° C., treated with 15 parts of calcium hydroxide for 30 minutes with rapid stirring, then filtered slowly through a thin pad of diatomaceous earth in a Buchner funnel to give the ester product.

EXAMPLE 5

A one-liter flask equipped as in Example 1 is charged with 200 parts (1 mole) tridecyl alcohol and 122 parts (0.5 moles) dimethyl-2,6-naphthalene dicarboxylate. Stirring is begun, 4 parts tetraisopropyltitanate is added, and the contents are heated to 180° C. and held for 6 hours, while methanol is removed under a slow nitrogen purge. At 50° C., the contents are filtered to give the desired product.

EXAMPLE 6

To a flask fitted per Example 1 are added 284 parts (2 moles) of trimellitic anhydride and 500 parts of xylene. The mixture is heated to 60° C., and 68 parts (0.5 mole) of pentaerythritol and 286 parts (2.2 moles) of 2,2,4-trimethylpentanol are added. The reaction mixture is further heated to 85° C. with good stirring, and 15 grams of p-toluenesulfonic acid monohydrate are added. The reaction mixture is taken to reflux and water is removed by azeotropic distillation over a 2-hour period. An additional 260 parts (2 moles) of 2,2,4-trimethylpentanol are added, and the mixture dehydrated at reflux over a 12-hour period. The temperature is gradually raised to 175° C. and held there for 3 hours, while volatiles are removed using a slow nitrogen purge. The mixture is stripped at 150° C./10 Torr, cooled to 85° C., stirred with 15 parts of calcium hydroxide for one hour, then filtered slowly through a pad of diatomaceous earth to give the ester product.

EXAMPLE 7

A one-liter flask equipped as in Example 1 is charged with 122 parts (0.5 moles) dimethyl-2,6-naphthalene dicarboxylate, 216 parts (1.5 moles) Alfol 8–10 alcohol and 4 parts tetraisopropyl titanate. The contents are heated to 150° C. and held for 3 hours, the temperature is increased to 165° C. for 2 hours, and finally 185° C. for 4 hours. The contents are stripped at 180° C. and 10 mm mercury and filtered to give a product that at 100° C. is solid.

EXAMPLE 8

A one-liter flask is charged with 99 parts (0.5 moles) 1,8-naphthalene anhydride, 172 parts (1.2 moles) Alfol 8–10 alcohol and 100 parts xylene. The flask is fitted with a thermowell, stirrer and Dean-Stark trap. Stirring is begun and 4 parts para-toluene sulfonic acid are added. Water is removed by azeotropic distillation until 9 parts water are obtained. At 90° C., 4 parts calcium hydroxide are added to neutralize the para-toluene sulfonic acid catalyst. Volatiles are removed by vacuum distillation at 220° C. and 2 mm mercury. The contents are filtered at room temperature to give a product having a neutralization number to phenolphthalein of 1.0.

As previously indicated, the compositions of this invention are useful as thermally and oxidatively stable synthetic fluids. They can be employed alone or in a variety of lubricants based on diverse oils of lubricating viscosity, including natural and synthetic lubricating and grease oils and mixtures thereof.

Synthetic lubricating oils include hydrocarbon oils and halo-substituted hydrocarbon oils such as polymerized and interpolymerized olefins [e.g., hydrogenated polybutylenes, hydrogenated polypropylenes, hydrogenated propylene-isobutylene copolymers, chlorinated hydrogenated polybutylenes, hydrogenated poly(1-hexenes), hydrogenated poly(1-octenes), hydrogenated poly(1-decenes)]; alkylbenzenes (e.g., dodecylbenzenes, tetradecylbenzenes, dinonylbenzenes, di(2-ethylhexyl) benzenes]; polyphenyls (e.g., biphenyls, terphenyls, alkylated polyphenyls); and alkylated diphenyl ethers and alkylated diphenyl sulfides and the derivatives, analogs and homologs thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, the alkyl and aryl ethers of these polyoxyalkylene polymers (e.g., methyl-polyisopropylene glycol ether having an average molecular weight of 1000, diphenyl ether of polyethylene glycol having a molecular weight of 500–1000, diethyl ether of polypropylene glycol having a molecular weight of 1000–1500); and mono- and polycarboxylic esters thereof, for example, the acetic acid esters, mixed $C_3$–$C_8$ fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and hydrogenated alkenyl succinic acids, maleic acid, azelaic acid, suberic acid; sebacic acid, fumaric acid, adipic acid, linoleic acid dimer, malonic acid, alkylmalonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol and tripentaerythritol.

Silicon-based oils such as the polyalkyl-, polyaryl-, polyalkoxy-, or polyaryloxysiloxane oils and silicate oils comprise another useful class of synthetic lubricants; they include tetraethyl silicate, tetraisopropyl silicate, tetra-(2-ethylhexyl) silicate, tetra-(4-methyl-2-ethylhexyl) silicate, tetra-(p-tert-butylphenyl) silicate, hexa-(4-methyl-2-pentoxy)disiloxane, poly(methyl)siloxanes and poly(methylphenyl) siloxanes. Other synthetic lubricating oils include liquid esters of phosphorus-containing acids (e.g., tricresyl phosphate, trioctyl phosphate, diethyl ester of decylphosphonic acid) and polymeric tetrahydrofurans.

Unrefined, refined and rerefined oils can be used in the lubricants of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art. Rerefined oils are obtained by processes similar to those used to obtain refined oils applied to refined oils which have been already used in service. Such rerefined oils are also known as reclaimed or reprocessed oils and often are additionally processed by techniques for removal of spent additives and oil breakdown products.

Normally the amount employed of the thermally oxidatively stable lubricants of the present invention will be about 10% to about 100%, preferably about 20% to about 90% of the total weight of the lubricating composition.

The term "minor amount" as used in the specification and appended claims is intended to mean that when a composition contains a "minor amount" of a specific material that amount is less than 50 percent by weight of the composition.

The term "major amount" as used in the specification and appended claims is intended to mean that when a composition contains a "major amount" of a specific material that amount is more than 50 percent by weight of the composition.

The invention also contemplates the use of additives in combination with the compositions of this invention sufficient to inhibit oxidation, corrosion, rust and improve extreme pressure antiwear properties. Such additives include, for example, detergents and dispersants of the ash-producing or ashless type, corrosion- and oxidation-inhibiting agents, pour point depressing agents, extreme pressure agents, antiwear agents, color stabilizers and anti-foam agents.

The ash-producing detergents are exemplified by oil-soluble neutral and basic salts of alkali or alkaline earth metals with sulfonic acids, carboxylic acids, or organic phosphorus acids characterized by at least one direct carbon-to-phosphorus linkage such as those prepared by the treatment of an olefin polymer (e.g., polyisobutene having a molecular weight of 1000) with a phosphorizing agent such as phosphorus trichloride, phosphorus heptasulfide, phosphorus pentasulfide, phosphorus trichloride and sulfur, white phosphorus and a sulfur halide, or phosphorothioic chloride. The most commonly used salts of such acids are those of sodium, potassium, lithium, calcium, magnesium, strontium and barium.

The term "basic salt" is used to designate metal salts wherein the metal is present in stoichiometrically larger amounts than the organic acid radical. The commonly employed methods for preparing the basic salts involve heating a mineral oil solution of an acid with an excess of a metal neutralizing agent such as the metal oxide, hydroxide, carbonate, bicarbonate, or sulfide at a temperature about 50° C. The use of a "promoter" in the neutralization step to aid the incorporation of a large excess of metal likewise is known. Examples of compound useful as the promoter include phenolic substances such as phenol, naphthol, alkylphenol, thiophenol, sulfurized alkylphenol, and condensation products of formaldehyde with a phenolic substance; alcohols such as methanol, 2-propanol, octyl alcohol, cellosolve, carbitol, ethylene glycol, stearyl alcohol, and cyclohexyl alcohol; and amines such as aniline, phenylenediamine, phenothiazine, phenyl-naphthylamine, and dodecylamine. A particularly effective method for preparing the basic salts comprises mixing an acid with an excess of a basic alkaline earth metal neutralizing agent and at least one alcohol promoter, and carbonating the mixture at an elevated temperature such as 60°-200° C.

Ashless detergents and dispersants are so called despite the fact that, depending on its constitution, the dispersant may upon combustion yield a non-volatile material such as boric oxide or phosphorus pentoxide; however, it does not ordinarily contain metal and therefore does not yield a metal-containing ash on combustion. Many types are known in the art, and any of them are suitable for use in the lubricant compositions of this invention. The following are illustrative:

(1) Reaction products of carboxylic acids (or derivatives thereof) containing at least about 34 and preferably at least about 54 atoms with nitrogen containing compounds such as amine, organic hydroxy compounds such as phenols and alcohols, and/or basic inorganic materials. Examples of these "carboxylic dispersants" are described in British Patent 1,306,529 and in many U.S. patents including the following:

| | | |
|---|---|---|
| 3,163,603 | 3,351,552 | 3,541,012 |
| 3,184,474 | 3,381,022 | 3,543,678 |
| 3,215,707 | 3,399,141 | 3,542,680 |
| 3,219,666 | 3,415,750 | 3,567,637 |
| 3,271,310 | 3,433,744 | 3,574,101 |
| 3,272,746 | 3,444,170 | 3,576,743 |
| 3,281,357 | 3,448,048 | 3,630,904 |
| 3,306,908 | 3,448,049 | 3,632,510 |
| 3,311,558 | 3,451,933 | 3,632,511 |
| 3,316,177 | 3,454,607 | 3,697,428 |
| 3,340,281 | 3,467,668 | 3,725,441 |
| 3,341,542 | 3,501,405 | 4,234,435 |
| 3,346,493 | 3,522,179 | Re 26,433 |

(2) Reaction products of relatively high molecular weight aliphatic or alicyclic halides with amines, preferably polyalkylene polyamines. These may be characterized as "amine dispersants" and examples thereof are described for example, in the following U.S. Pat. Nos.: 3,275,554; 3,454,555; 3,438,757 and 3,565,804.

(3) Reaction products of alkyl phenols in which the alkyl group contains at least about 30 carbon atoms with aldehydes (especially formaldehyde) and amines (especially polyalkylene polyamines), which may be characterized as "Mannich dispersants". The materials described in the following U.S. patents are illustrative:

| | | |
|---|---|---|
| 2,459,112 | 3,442,808 | 3,591,598 |
| 2,962,442 | 3,448,047 | 3,600,372 |
| 2,984,550 | 3,545,497 | 3,634,515 |
| 3,036,003 | 3,459,661 | 3,649,229 |
| 3,166,516 | 3,461,172 | 3,697,574 |
| 3,236,770 | 3,493,520 | 3,725,277 |
| 3,355,270 | 3,539,633 | 3,725,480 |
| 3,368,972 | 3,558,743 | 3,726,882 |
| 3,413,347 | 3,586,629 | 3,980,569 |

(4) Products obtained by post-treating the carboxylic, amine or Mannich dispersants with such reagents as urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. Pat. Nos.:

| | | | |
|---|---|---|---|
| 3,036,003 | 3,282,955 | 3,493,520 | 3,639,242 |
| 3,087,936 | 3,312,619 | 3,502,677 | 3,649,229 |
| 3,200,107 | 3,366,569 | 3,513,093 | 3,649,659 |
| 3,216,936 | 3,367,943 | 3,533,945 | 3,658,836 |
| 3,254,025 | 3,373,111 | 3,539,633 | 3,697,574 |
| 3,256,185 | 3,403,102 | 3,573,010 | 3,702,757 |
| 3,278,550 | 3,442,808 | 3,579,450 | 3,703,536 |
| 3,280,234 | 3,455,831 | 3,591,598 | 3,704,308 |
| 3,281,428 | 3,455,832 | 3,600,372 | 3,708,422 |

(5) Interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. These may be characterized as "polymeric dispersants" and examples thereof are disclosed in the following U.S. Pat. Nos.: 3,329,658; 3,366,730; 3,449,250; 3,687,849; 3,519,565 and 3,702,300.

The above-noted patents are incorporated by reference herein for their disclosures of ashless dispersants.

Extreme pressure agents and corrosion- and oxidation-inhibiting agents which may be included in this invention are exemplified by chlorinated aliphatic hydrocarbons such as chlorinated wax; aromatic amines such as dioctyl diphenylamine hindered phenols such as methylenebis-2,6-t-butyl phenol, organic sulfides and polysulfides such as benzyl disulfide, bis(chlorobenzyl) disulfide, dibutyl tetrasulfide, sulfurized methyl ester of oleic acid, sulfurized alkylphenol, sulfurized dipentene, and sulfurized terpene; phosphosulfurized hydrocarbons such as the reaction product of a phosphorus sulfide with turpentine or methyl oleate, phosphorus esters including principally dihydrocarbon and trihydrocarbon phosphites such as dibutyl phosphite, diheptyl phosphite, dicyclohexyl phosphite, pentylphenyl phosphite, dipentylphenyl phosphite, tridecyl phosphite, distearyl phosphite, dimethyl naphthyl phosphite, oleyl 4-pentylphenyl phosphite, polypropylene (molecular weight 500)-substituted phenyl phosphite, diisobutyl-substituted phenyl phosphite; metal thiocarbamates, such as zinc dioctyldithiocarbamate, and barium heptylphenyl dithiocarbamate; Group II metal phosphorodithioates such as zinc dicyclohexylphosphorodithioate, zinc dioctylphosphorodithioate, barium di(heptylphenyl)-phosphorodithioate, cadmium dinonylphosphorodithioate, and the zinc salt of a phosphorodithioic acid produced by the reaction of phosphorus pentasulfide with an equimolar mixture of isopropyl alcohol and n-hexyl alcohol.

Many of the above-mentioned extreme pressure agents and corrosion- oxidation inhibitors also serve as antiwear agents. Zinc dialkylphosphorodithioates are a well known example.

Pour point depressants are a particularly useful type of additive often included in the lubricating oils described herein. The use of such pour point depressants in oil-based compositions to improve low temperature properties is well known in the art. See, for example, page 8 of "Lubricant Additives" by C. V. Smalheer and R. Kennedy Smith (Lezius-Hiles Co. publishers, Cleveland, Ohio, 1967).

Examples of useful pour point depressants are polymethacrylates, polyacrylates; polyacrylamides; condensation products of haloparaffin waxes and aromatic compounds; vinyl carboxylate polymers; and terpolymers of dialkylfumarates, vinylesters of fatty acids and alkylvinylethers. Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878; and 3,250,715 which are hereby incorporated by reference for their relevant disclosures.

Anti-foam agents are used to reduce or prevent the formation of stable foam. Typical anti-foam agents include silicones or organic polymers. Additional anti-foam compositions are described in "Foam Control Agents", by Henry T. Kerner (Noyes Data Corporation, 1976), pages 125-162.

The thermal stability of the compositions of this invention, as measured by thermal gravimetric analysis on products of Examples 3, 5, 7 and 8 on a DuPont Instruments 951 Thermogravimetric analyzer, is shown in the following Table I. The higher the onset temperature, the greater the thermal stability possessed by the composition. Commercially available synthetic fluids that have utility as thermally stable fluids include Emery 3004, a poly alpha-olefin available from Emery Industries, Inc. and Emery 2982, a polyol neo ester available from Emery Industries, Inc. These commerically available fluids are shown as baselines in Table I.

TABLE I

Thermal Gravimetric Analysis

| Sample | Onset Temperature °C. |
|---|---|
| Emery 3004 (baseline) | 238 |
| Emery 2982 (baseline) | 250 |
| Example 3 | 312 |
| Example 5 | 360 |
| Example 7 | 320 |
| Example 8 | 264 |

The pressure differential scanning calorimetry, (PDSC), as measured on products of Example 5 and 7 on a DuPont Instruments 910 Differential Scanning Calorimeter (DSC), is shown in the following Table II. The higher the onset temperature, the greater the oxidative stability. The commerically available fluids shown as baselines are described under Thermal Gravimetric Analysis.

TABLE II

Pressure Differential Scanning Calorimetry

| Sample | Onset Temperature °C. |
|---|---|
| Emery 3004 (baseline) | 198 |
| Emery 2982 (baseline) | 211 |
| Example 5 | 298 |
| Example 7 | 298 |

The instant invention is shown and described herein and is considered to be the most practical and preferred embodiments. It is recognized, however, that departures may be made therefrom which are within the scope of the invention and that obvious modifications will occur to one skilled in the art upon reading this disclosure.

What is claimed is:

1. A composition comprising an aromatic carboxylic acid ester of the general formula

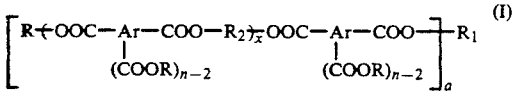

(I)

wherein Ar is an aromatic moiety, R is a neo hydrocarbyl group containing from about 5 to about 18 carbon atoms, with the proviso that R is not a cycloalkyl substituted neo hydrocarbyl group, $R_1$ is a tri or tetra functional hydrocarbyl group containing from 1 to about 18 carbon atoms, n is an integer from about 2 to about 4 and represents the total number of carboxylic acid ester groups on the aromatic moiety, a is an integer from about 3 to about 4, when a is 3 $R_1$ is trivalent and when a is 4 $R_1$ is tetravalent, $R_2$ is a hydrocarbyl group derived from a diol containing from about 2 to about 18 carbon atoms and x is an integer from 0 to about 4.

2. The composition according to claim 1 wherein the aromatic moiety is a benzene nucleus.

3. The composition according to claim 2 wherein n is 2.

4. The composition according to claim 2 wherein n is 3.

5. The composition according to claim 3 wherein x is 0.

6. The composition according to claim 4 wherein x is 0.

7. The composition according to claim 5 wherein a is 3.

8. The composition according to claim 5 wherein a is 4.

9. The composition according to claim 6 wherein a is 3.

10. The composition according to claim 6 wherein a is 4.

11. The composition according to claim 1 wherein the aromatic moiety is a naphthalene moiety.

12. The composition according to claim 11 wherein n is 2.

13. The composition according to claim 11 wherein n is 3.

14. The composition according to claim 12 wherein x is 0.

15. The composition according to claim 13 wherein x is 0.

16. The composition according to claim 14 wherein a is 3.

17. The composition according to claim 14 wherein a is 4.

18. The composition according to claim 15 wherein a is 3.

19. The composition according to claim 15 wherein a is 4.

20. A concentrate which comprises a minor proportion of a lubricating oil and a major proportion of an aromatic carboxylic acid ester of the composition according to claim 1.

21. A concentrate which comprises a minor proportion of a lubricating oil and a major proportion of an aromatic carboxylic acid ester of the composition according to claim 2.

22. A concentrate which comprises a minor proportion of a lubricating oil and a major proportion of an aromatic carboxylic acid ester of the composition according to claim 11.

23. A lubricant composition which comprises a major proportion of a lubricating oil and a minor proportion of an aromatic carboxylic acid ester of the composition according to claim 1.

24. A lubricant composition which comprises a major proportion of a lubricating oil and a minor proportion of an aromatic carboxylic acid ester of the composition according to claim 2.

25. A lubricant composition which comprises a major proportion of a lubricating oil and a minor proportion of an aromatic carboxylic acid ester of the composition according to claim 11.

26. A composition comprising an aromatic carboxylic acid ester of the general formula

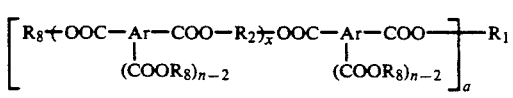

(VII)

wherein Ar is an aromatic moiety, $R_8$ comprises a mixture of R and $R_5$ wherein R is a neo hydrocarbyl group containing from about 5 to about 18 carbon atoms, with the proviso that R is not a cycloalkyl substituted neo hydrocarbyl group, $R_5$ is a linear primary hydrocarbyl group containing from about 2 to about 18 carbon atoms, $R_1$ is a tri or tetra functional hydrocarbyl group containing from 1 to about 18 carbon atoms, n is an integer from about 2 to about 4 and represents the total number of carboxylic acid ester groups on the aromatic moiety, a is an integer from about 3 to about 4, when a is 3 $R_1$ is trivalent and when a is 4 $R_1$ is tetravalent, $R_2$ is a hydrocarbyl group derived from a diol containing from about 2 to about 18 carbon atoms and x is an integer from 0 to about 4.

27. A composition comprising an aromatic carboxylic acid ester

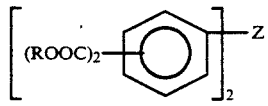

(II)

wherein R is a neo hydrocarbyl group containing from about 5 to about 18 carbon atoms and Z is selected from the group consisting of

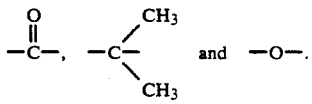

28. A concentrate which comprises a minor proportion of a lubricating oil and a major proportion of an aromatic carboxylic acid ester of the composition according to claim 27.

29. A lubricant composition which comprises a major proportion of a lubricating oil and a minor proportion of an aromatic carboxylic acid ester of the composition according to claim 27.

30. A composition comprising an aromatic carboxylic acid ester of the structure

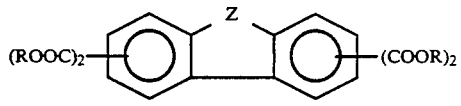

(III)

wherein R is a neo hydrocarbyl group containing from about 5 to about 18 carbon atoms and Z is selected from the group consisting of

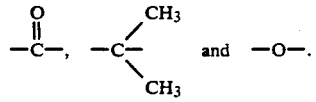

31. A concentrate which comprises a minor proportion of a lubricating oil and a major proportion of an aromatic carboxylic acid ester of the composition according to claim 30.

32. A lubricant composition which comprises a major proportion of a lubricating oil and a minor proportion of an aromatic carboxylic acid ester of the composition according to claim 30.

33. A thermal oxidatively stable synthetic fluid composition comprising an aromatic carboxylic acid ester of the general formula

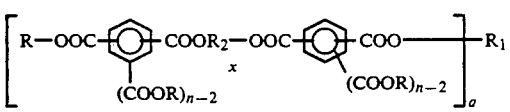

(IV)

wherein R is a neo hydrocarbyl group containing from 5 to 10 carbon atoms, $R_1$ is a tri or tetra functional hydrocarbyl group containing from about 5 to about 16 carbon atoms, n is an integer from about 2 to about 4 and represents the total number of carboxylic acid ester groups on the aromatic moiety; a is 3 or 4 with the proviso that when a is 3 $R_1$ is trivalent and when a is 4 $R_1$ is trivalent, $R_2$ is a hydrocarbyl group from a diol containing from about 2 to about 12 carbon atoms and x is an integer from 0 to about 4.

34. The composition according to claim 33 wherein a is 3 and $R_1$ is a tri functional hydrocarbyl group containing from about 5 to about 12 carbon atoms.

35. The composition according to claim 33 wherein a is 4 and $R_1$ is a tetra functional hydrocarbyl group containing from about 5 to about 12 carbon atoms.

36. A concentrate which comprises a minor proportion of a lubricating oil and a major proportion of an aromatic carboxylic acid ester of the composition according to claim 33.

37. A lubricant composition which comprises a major proportion of a lubricating oil and a minor proportion of an aromatic carboxylic acid ester of the composition according to claim 33.

38. A thermal oxidatively stable synthetic fluid composition comprising an aromatic carboxylic acid ester of the formula

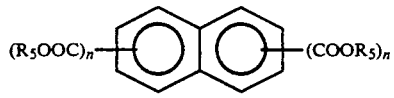

(V)

wherein $R_5$ is a hydrocarbyl group containing from about 2 to about 18 carbon atoms with the proviso that $R_5$ is a primary hydrocarbyl group other than a neo hydrocarbyl group and n is independently an integer from about 2 to about 4 with the proviso that there can be no more than four ($COOR_5$) groups total in the ester.

39. A composition according to claim 38 wherein $R_5$ is a hydrocarbyl group containing from 5 to about 18 carbon atoms with the proviso that $R_5$ is a hydrocarbyl group other than a neo hydrocarbyl group.

40. A concentrate which comprises a minor proportion of a lubricating oil and a major proportion of an aromatic carboxylic acid ester of the composition according to claim 38.

41. A lubricant composition which comprises a major proportion of a lubricating oil and a minor proportion of an aromatic carboxylic acid ester of the composition according to claim 38.

42. A composition comprising an aromatic carboxylic acid ester of the general formula

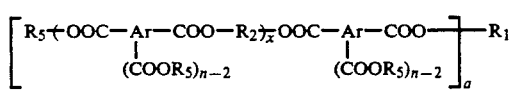

(VI)

wherein Ar is an aromatic moiety, $R_5$ is a linear hydrocarbyl group containing from about 2 to about 18 carbon atoms, $R_1$ is a tri or tetra functional hydrocarbyl group containing from 1 to about 18 carbon atoms, n is an integer from about 2 to about 4 and represents the total number of carboxylic acid ester groups on the aromatic moiety, a is 3 or 4, when a is 3 $R_1$ is trivalent and when a is 4 $R_1$ is tetravalent, $R_2$ is a hydrocarbyl group derived from a diol containing from about 2 to about 18 carbon atoms and x is an integer from 0 to about 4.

43. A composition comprising an aromatic carboxylic acid ester of the general formula

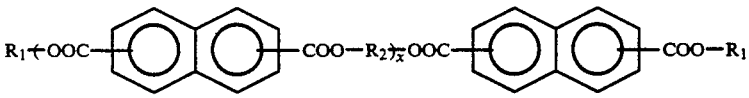

(VIII)

wherein $R_1$ is a mono functional primary hydrocarbyl group containing from 1 to about 18 carbon atoms, $R_2$ is a hydrocarbyl group derived from a diol containing from about 2 to about 18 carbon atoms and x is an integer from 1 to about 4.

44. A composition comprising an aromatic carboxylic acid ester of the general formula

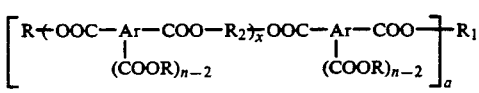

(I)

wherein Ar is a naphthalene moiety, R is a neo hydrocarbyl group containing from about 5 to about 18 carbon atoms, with the proviso that R is not a cycloalkyl substituted neo hydrocarbyl group, $R_1$ is a di functional hydrocarbyl group containing from 1 to about 18 carbon atoms, n is an integer from about 2 to about 4 and represents the total number of carboxylic acid ester groups on the aromatic moiety, a is 2, $R_1$ is divalent, $R_2$ is a hydrocarbyl group derived from a diol containing from about 2 to about 18 carbon atoms and x is an integer from 1 to about 4.

45. The composition according to claim 44 wherein n is 2.

46. The composition according to claim 44 wherein n is 3.

47. The composition according to claim 45 wherein x is 0.

48. The composition according to claim 46 wherein x is 0.

49. A concentrate which comprises a minor proportion of a lubricating oil and a major proportion of an aromatic carboxylic acid ester of the composition according to claim 44.

50. A concentrate which comprises a minor proportion of a lubricating oil and a major proportion of an aromatic carboxylic acid ester of the composition according to claim 45.

51. A lubricant composition which comprises a major proportion of a lubricating oil and a minor proportion of an aromatic carboxylic acid ester of the composition according to claim 44.

52. A lubricant composition which comprises a major proportion of a lubricating oil and a minor proportion of an aromatic carboxylic acid ester of the composition according to claim 45.

53. A lubricant composition which comprises a major proportion of a lubricating oil and a minor proportion of an aromatic carboxylic acid ester of the composition according to claim 46.

* * * * *